US005238437A

United States Patent [19]

Vowles et al.

[11] Patent Number: 5,238,437

[45] Date of Patent: Aug. 24, 1993

[54] BUBBLE DISPENSING DOLL

[75] Inventors: Colin Vowles, Manhattan Beach; Jill E. Barad, Pacific Palisades; Robin K. Smith, Long Beach; Howard R. Stern, Redondo Beach, all of Calif.

[73] Assignee: Mattel, Inc., El Segundo, Calif.

[21] Appl. No.: 832,250

[22] Filed: Feb. 7, 1992

[51] Int. Cl.[5] ..... A63H 33/28; A63H 3/00

[52] U.S. Cl. ..... 446/15; 446/268

[58] Field of Search ..... 446/15-21, 446/27, 268

[56] References Cited

U.S. PATENT DOCUMENTS

| | | | |
|---|---|---|---|
| 1,021,323 | 3/1912 | McMurtry | 446/15 X |
| 3,100,947 | 8/1963 | Hellman | 446/16 |
| 3,736,694 | 6/1973 | Lebensfeld | 446/16 |
| 3,775,899 | 12/1973 | Wolf | 446/27 X |
| 3,845,583 | 11/1974 | Ziff | 446/17 |
| 4,299,049 | 11/1981 | Pimentel et al. | 446/15 |

*Primary Examiner*—Mickey Yu

*Attorney, Agent, or Firm*—Roy A. Ekstrand

[57] ABSTRACT

A bubble dispensing doll includes a hollow torso and head configured to resemble a mermaid. The doll head supports a quantity of simulated hair and a head piece ornament preferably formed in the configuration of a crown or the like. A bubble producing mechanism is formed into an integral self-supporting mechanism which is received and supported within an upper aperture of the doll's head. The majority of the bubble producing mechanism is received within the head and torso cavity of the doll and includes a battery-powered air impeller which drives an air stream through a foaming chamber within the bubble producing mechanism.

9 Claims, 2 Drawing Sheets 26
22
29
23
3
21
10
20
27
25
3
17
11
13
12
14
15
16

26
24
29
25
23
27
21
20
44
45
41
17
46
11
10
40
12
42
43

BUBBLE DISPENSING DOLL

FIELD OF THE INVENTION

This invention relates generally to toy dolls and particularly to those having supplemental activity features.

BACKGROUND OF THE INVENTION

One of the most long lasting and pervasive of childrens toys is found in dolls and toy figures. From earliest times, parents have fashioned doll toys for use by children of a wide variety of ages. In addition, commercial manufacturers have, for many years, provided a virtually endless variety of dolls to enlighten and amuse children of all ages. Dolls have varied from relatively simple non-functional toys to dolls having complex activities. For example, dolls have been provided which have exhibited abilities to speak, cry and undergo various motions such as crawling, walking or even skating. Dolls have also been provided which undergo physiological activities such as crying, wetting and drinking.

In addition to dolls which emphasize realistic mimicry of human activities, dolls have been provided which assume fantasy or fanciful themes. In accordance with such themes, dolls have been provided in such varied roles as princesses, pixies, mermaids and so on. The objective in such theme based dolls is to provide amusement and interest as well as excitement and one or more interrelated activities. For example, mermaid dolls have been produced by practitioners in the art which are able to swim within a water environment.

Despite the great variety of quality of dolls provided by practitioners in the art, there remains nonetheless a continuing need in the art for evermore varied, interesting and creative dolls.

SUMMARY OF THE INVENTION

Accordingly, it is a general object of the present invention to provide an improved doll. It is a more particular object of the present invention to provide an improved doll having a thematically coordinated activity which further enhances the excitement and themed character of the doll.

In accordance with the present invention, there is provided a doll comprises: a doll body defining an interior cavity and having at least arm appendages, a head, and a torso; a head piece ornament upon the upper portion of the head; bubble dispensing means within the interior cavity for producing a stream of bubbles formed of a bubble solution; a bubble solution reservoir supported by the head and head piece coupled to the bubble dispensing means; and a bubble dispensing nozzle extending upwardly from the head and head piece ornament.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
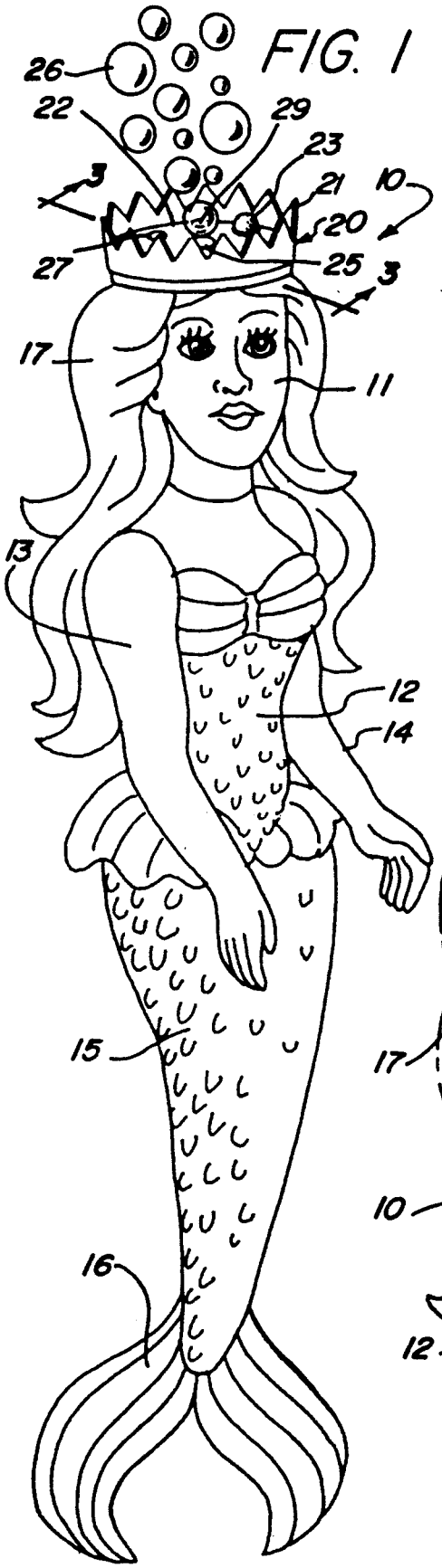
FIG. 1 sets forth a perspective view of a bubble dispensing doll constructed in accordance with the present invention.

FIG. 1 sets forth a front perspective view of a bubble dispensing doll constructed in accordance with the present invention and generally referenced by numeral 10. Doll 10 includes a head 11, a torso 12 and a pair of pivotally attached arms 13 and 14. Doll 10 further includes a tail portion 15 and fin portion 16. Doll 10 is intended to create a fanciful depiction of a mermaid having human-like arms, head, hair, face and the like while also having the fish-like lower body and fins characteristic of mythical mermaid creatures. A head piece ornament 20 formed to replicate a crown, tiara, or similar article is supported upon head 11 by mean set forth below in greater detail. Head piece ornament 20 is shown in the figures which follow as a crown-like ornament. However, it will be apparent to those skilled in the art that additional ornamental head pieces may be created and secured in the fashion shown for headpiece ornament 20 without departing from the spirit and scope of the present invention. A quantity of human-like hair 17 is secured to head 11 about crown 20 using conventional fabrication techniques such as the commonly used hair rooting process.

Crown 20 includes an upwardly extending outer picket 21 and an interior portion 22. Interior portion 22 defines an air vent 27, a bubble dispensing nozzle 25 and a switch 23. As is better seen in FIG. 2, crown 20 also includes a downwardly extending passage 24 forming a filler passage and supporting a sealing cap 29.

In operation, doll 10 includes a bubble producing and dispensing apparatus (better seen in FIGS. 2 through 4) which is operative in response to switch 23 to produce an upwardly directed stream of bubbles 26 emanating from bubble nozzle 25 within crown 20. The bubble stream formed by bubbles 26 provides a simulation of the air bubbles which are generally associated with the underwater environment within which mermaids are found in typical stories, legends and so on. Thus, as bubbles 26 continue to emanate from nozzle 25 within crown 20 and tend to persist and collect about doll 10, an exciting and fanciful depiction of a mermaid doll is created which children find extremely exciting and amusing. The use of head piece ornament 20 in the manner shown to include an upwardly extending fence-like outer member such as outer picket 21 of the crown ornament shown provides additional advantage in that the various operative devices such as switch 23, air vent 27, nozzle 25 and filler cap 29 may be supported upon inner portion 22 and thus obscured or covered over by picket 21. As is better seen in FIG. 2, this construction is advantageous in that it provides the fabrication of an integral and complete bubble producing mechanism which may be secured within and removed from head 11 and torso 12 of doll 10 as a single unit offering considerable advantage in its manufacture, maintenance and ease of use.

Figure 2:
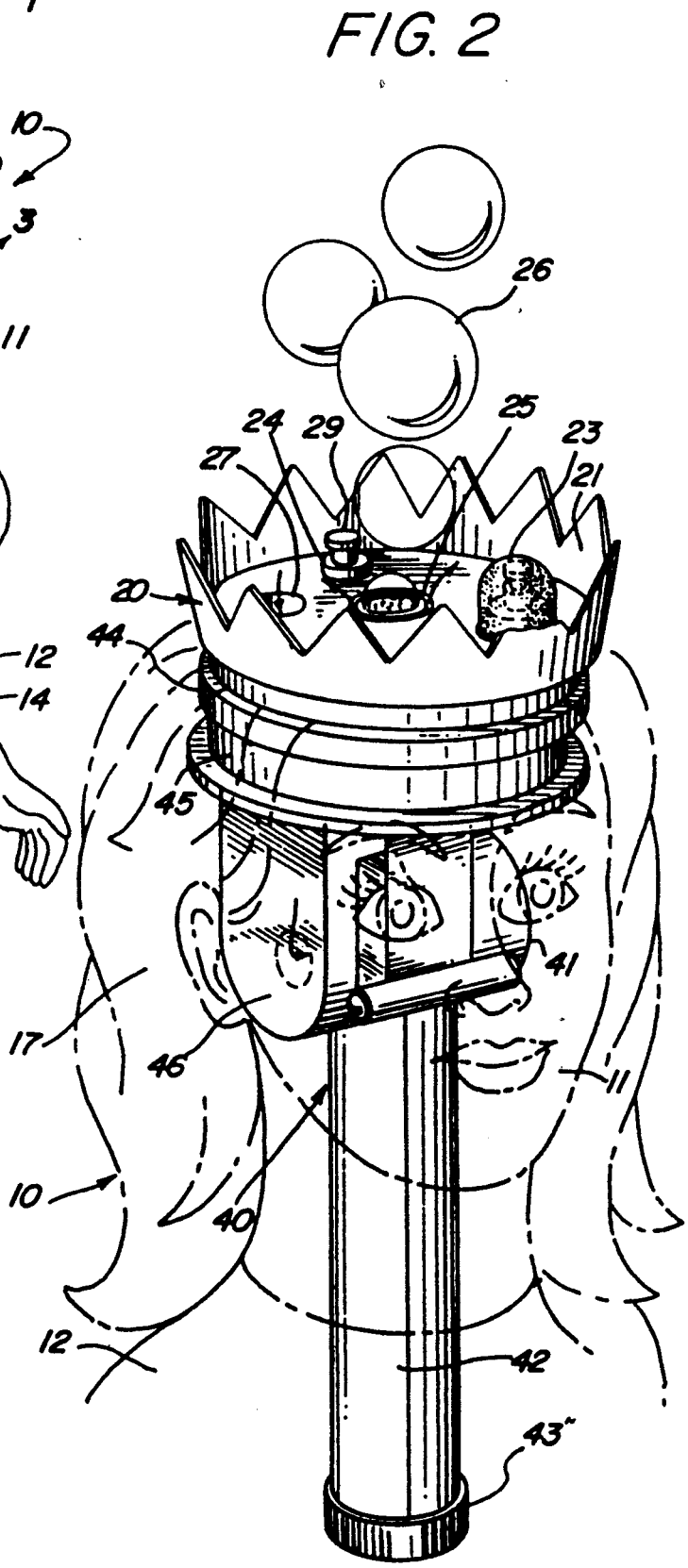
FIG. 2 sets forth a perspective view of the bubble dispensing portion of the present invention doll.

FIG. 2 sets forth a perspective view of the head and upper torso portion of doll 10 supporting head piece ornament 20 together with a bubble producing mechanism 40. For purposes of illustration, the outer portions of doll 10 are shown in dashed-line representation. As is set forth above, doll 10 includes a torso 12, a head 11 and a quantity of simulated hair 17.

A bubble producing mechanism generally referenced by numeral 40 includes an upper housing 44 defining an annular groove 45, a lower housing 41 having a fan chamber 46 formed therein and a battery housing 42 extending downwardly from lower housing 41. Battery housing 42 further includes a cylindrical cap 43 at the lower end thereof.

Crown 20 includes a generally planar interior portion 22 having a surrounding upwardly extending outer picket 21. Interior portion 22 defines an air vent 27 and a filler passage 24. A bubble nozzle 25 extends upwardly through interior portion 21 and a switch 23 is supported upon interior portion 21 in the manner set forth below in greater detail.

In accordance with an important aspect of the present invention, bubble producing mechanism 40 is fabricated to provide a complete integral assembly comprising crown 20, upper housing 44, lower housing 41, and battery housing 42. As is better seen in FIG. 3, annular 45 of upper housing 44 cooperates with a corresponding lip 47 formed in head 11 to secure bubble producing mechanism 40 within head 11 and torso 12 of doll 10 in the position shown in FIG. 2. Thus, the entire bubble producing mechanism is removable from doll 10 as a single unit providing substantial advantage for assembly and maintenance of the present invention doll.

Figure 3:
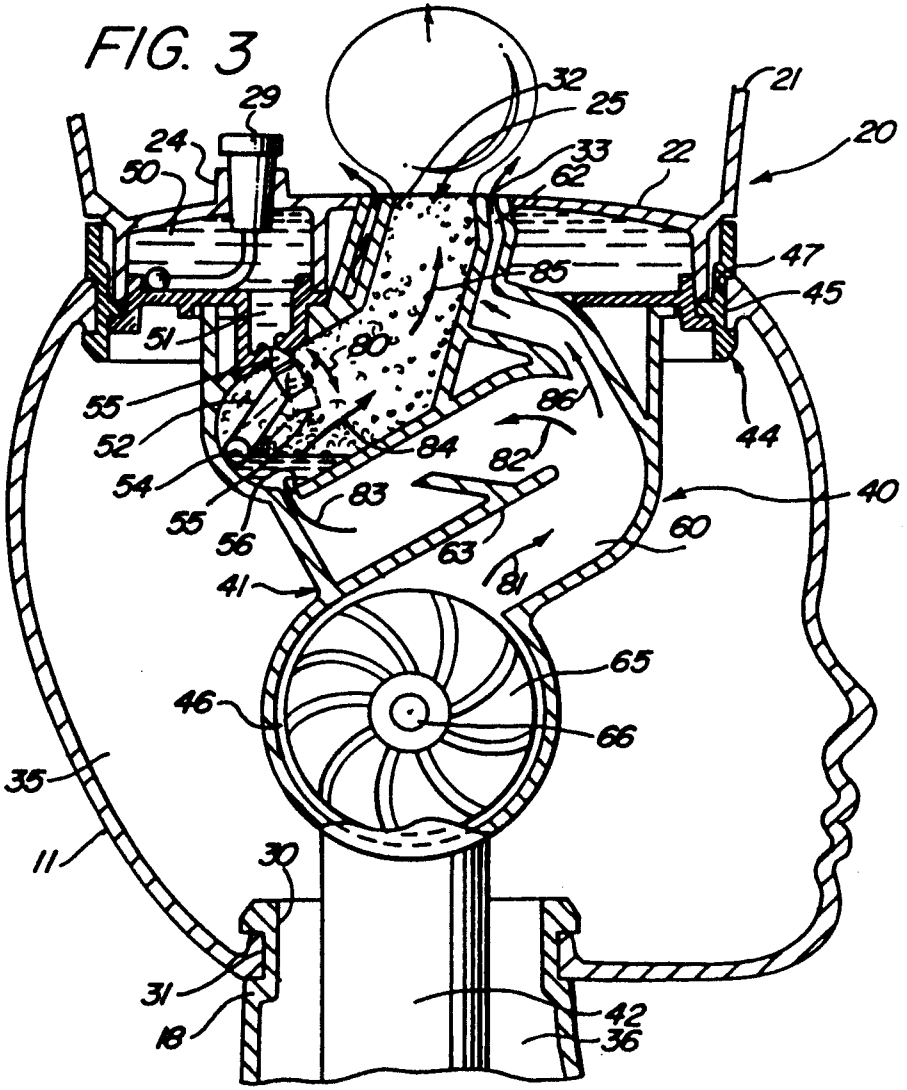
FIG. 3 sets forth a section of the present invention bubble dispensing doll taken along section lines 3—3 in FIG. 1.

In operation, cap 29 is opened to permit a quantity of bubble solution to be introduced into solution reservoir 50 (seen in FIG. 3). Thereafter, cap 29 is replaced. When the bubbling action of doll 10 is desired, switch 23 is activated which, in accordance with the operation set forth below in greater detail, introduces a quantity of solution into lower housing 41. Concurrently, the air circulating means of bubble producing mechanism 40 described below is operative to draw air into housing 41 through air vent 27. Thereafter, the bubble producing operation described below is carried forward to provide a stream of bubbles 26 emanating from bubble nozzle 25 of crow 20. While the preferred form of bubble producing mechanism 40 is set forth below in FIGS. 3 and 4, it will be apparent to those skilled in the art that a variety of different bubble producing mechanisms may be utilized within lower housing 41 to satisfy the bubble producing needs of the present invention without departing from the spirit and scope thereof. In its preferred form, switch 23 comprises a latching switch constructed in accordance with conventional fabrication techniques which is operative to maintain the bubbling action once switch 23 is pressed until it is desired to terminate the bubbling action at which time switch 23 is again pressed to interrupt and terminate the bubble producing activity.

FIG. 3 sets forth a section view of the present invention bubble dispensing doll taken along section lines 3—3 in FIG. 1. Doll 10 includes a head 11 defining an interior cavity 35. Head 11 defines a circular lip 30 at the lower portion thereof and a larger circular lip 47 on the upper portion thereof. A neck 18 defines an interior cavity 36 having an annular groove 37 which receives lip 30 of head 11. Neck 18 further defines an interior cavity 36 which extends downwardly into torso 12 (seen in FIG. 1). As is described above, a bubble producing mechanism 40 includes an upper housing 44, a lower housing 41 and a battery housing 42 formed and assembled as an integral bubble producing mechanism. Upper housing 44 defines an annular groove 45 which receives lip 47 of head 11 to secure and support bubble producing mechanism 40. Upper housing 44 extends downwardly into interior cavity 35 and supports a head piece ornament 20 which, as mentioned above, forms a crown in the embodiment shown in FIGS. 1 through 4. Crown 20 defines an upwardly extending outer picket 21 and a curved planar interior portion 22. Crown 20 further defines a reservoir 50 having a filler 24 which receives a sealing cap 29. In accordance with the present invention, a quantity of bubble producing solution is received within reservoir 50 having been transferred thereto through filler 24 afterwhich cap 29 is inserted therein to captivate the bubble producing solution within reservoir 50.

Lower housing 41 defines a foam chamber 55 having an aperture 56 at the lower portion thereof and terminating in an enlarged center aperture 32 extending through the surface of interior portion 22 of crown 20. Reservoir 50 further defines a valve aperture 51 having a generally small diameter and defining conical valve seating surfaces which open into foam chamber 55. A pivot arm 53 is pivotally supported within foam chamber 55 by means better seen in FIG. 4 and supports a pivot arm 53 which in turn supports a generally conical valve stopper 52. Valve stopper 52 is preferably formed of a resilient sealing material such as rubber or the like and defines a conical shape corresponding to the surfaces of aperture 51 and thus, when inserted therein provides a sealing closure of aperture 51.

Lower housing 41 further defines a generally cylindrical fan chamber 46 and an air plenum 60 extending upwardly from fan chamber 46. Plenum 60 further defines an aperture 56 coupling plenum 60 to foam chamber 55, an interior baffle 63, and an upwardly extending air duct 61. Air duct 61 defines an annular passage 62 which surrounds nozzle 25 and terminates at the upper surface of interior portion 22 in an annular space 33. An air impeller 65 is supported upon a motor shaft 66 and is rotatable within fan chamber 46 in response to the energizing of motor 67 (seen in FIG. 4).

Figure 4:
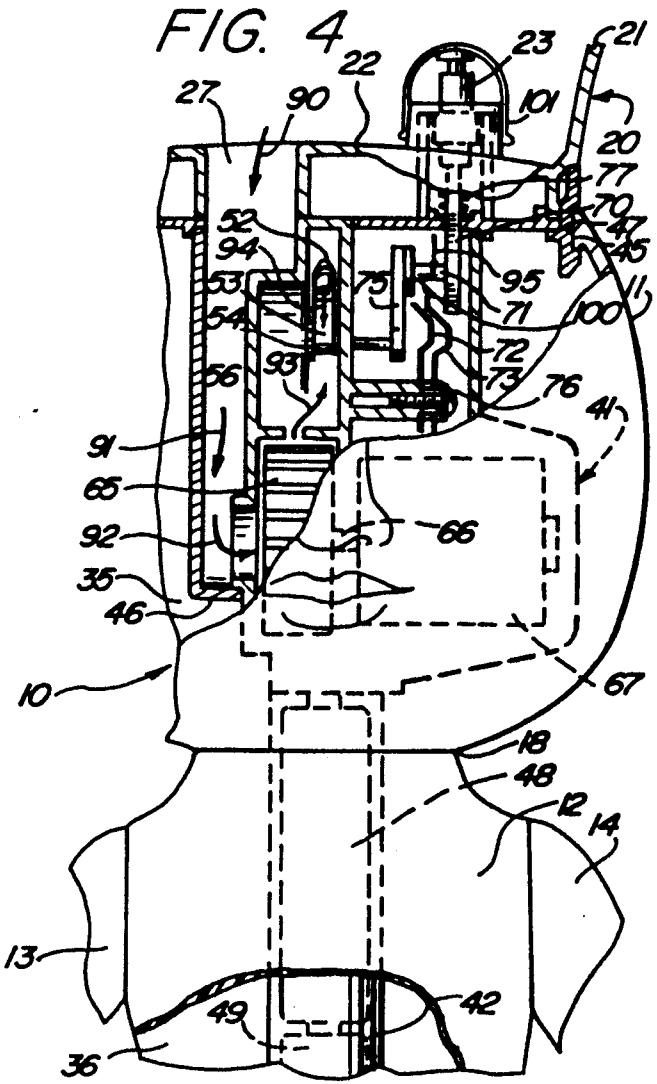
FIG. 4 sets forth a partial section frontal view of the present invention bubble dispensing doll.

Battery housing 42 supports a pair of batteries 48 and 49 (seen in FIG. 4) and extends downwardly from the fan chamber portion of lower housing 41 passing through neck 18 and extending into interior cavity 36 of torso 12 as is better seen in FIG. 4.

In operation, the energizing of motor 67 operates by means set forth below in FIG. 4 to simultaneously rotate air impeller 65 and pivot pivot arm 53 away from valve aperture 51 of reservoir 50 in the direction indicated by arrow 80. With the pivoting of valve stopper 52 away from aperture 51, a quantity of solution is transferred from reservoir 50 to foam chamber 55. Simultaneously, the spinning of air impeller 65 produces a flow of air through air plenum 60 in the direction indicated by arrow 81. This air flow divides at air duct 61 in the manner indicated by arrows 82 and 86. A small portion of the air flow thus divided is forced upwardly through aperture 56 of foam chamber 55 in the direction indicated by arrows 83, 84 and 85. The small size of aperture 56 produces a foaming action of the bubbling solution within chamber 55 which tends to be carried upwardly to nozzle 25 in the direction of arrows 84 and 85 by the small air flow through foam chamber 55.

The continuing air flow through duct 61 which comprises the major portion of the air flow provided by air impeller 65 flows upwardly through duct 61 and outwardly in a generally cylindrical air flow pattern emanating from annular space 33. This air flow carries a portion of the foam within center aperture 32 of nozzle 25 outwardly forming a bubble which grows in size until it separates from the foam solution within center aperture 32 thus forming a bubble which is then carried away from nozzle 25 by the continuing air flow from annular space 33. This process continues so long as motor 67 is energized to rotate air impeller 65 and so long as a supply of bubble producing solution is present within foam chamber 55. When the bubble producing action is desired to be terminated, motor 67 is deenergized and the air flow through bubble producing mechanism 40 ceases.

FIG. 4 sets forth a partial frontal view of doll 10 partially sectioned to reveal the interior structure of bubble producing mechanism 40. As described above, doll 10 includes a head 11 defining an interior cavity 35 and an annular lip 47 at the upper portion thereof. Head 11 is secured to torso 12 at neck 18 in the manner described in FIG. 3. As is also described above, bubble producing mechanism 40 includes an upper housing 44, a lower housing 41 and a battery housing 42 all formed as an integral unit assembled into the interior cavities of head 11 and torso 12 in the manner described above. Upper housing 44 defines an annular groove 45 which receives lip 47 of head 11 to provide secure attachment between upper housing 44 and head 11. The remainder of upper housing 44, lower housing 41 and battery housing 42 extend downwardly through interior cavity 35 of head 11 and into interior cavity 36 formed in torso 12 and neck 18.

Upper housing 44 further supports crown 20 which includes an outer picket 21 and an interior portion 22. A push button switch 23 is supported upon interior portion 22 and includes an inwardly extending arm 70 operated in combination therewith. Crown 20 further includes a reservoir 50 for receiving and supporting a quantity of bubble producing solutions. Push button switch 23, in its preferred form, includes a geneva latch mechanism 101 which in accordance with conventional fabrication techniques is operative to maintain push button switch 23 in a depressed position each time it is initially pushed down and to release push button switch 23 each time it is pressed again when in a latched depressed position. A return spring 77 is supported within crown portion 20 and urges push button 23 and arm 70 upwardly to provide a return force therefor. Arm 70 further includes an angled cam surface 100 and an outwardly extending link 71. The latter is coupled to a crank arm 75 which in turn is coupled to pivot 54. Pivot 54, as mentioned above, supports a pivoting arm 53 which in turn supports valve stopper 52 in sealing engagement with valve aperture 51 of reservoir 50 (better seen in FIG. 3). For purposes of illustration, the structure of valve aperture 51 is omitted from FIG. 4 to provide better illustration of the shape of valve stopper 52.

Lower housing 41 further includes an extending boss 76 which supports a pair of electrical contacts 72. A conventional motor 67 is received and supported within lower housing 41 and includes an output shaft 66 which in turn is coupled to an air impeller 65. As described above, air impeller 65 is received within a generally cylindrical fan chamber 46. A pair of batteries 48 and 49 are supported within battery housing 42 and provide operating power for motor 67. While not seen in FIGS. 3 and 4, it should be understood that conventional electrical connections are provided between contacts 72 and 73, motor 67, and batteries 48 and 49 to provide energizing of motor 67. For example, these connections may be obtained by conventional lead wires or, in the alternative, may be fabricated using ribbon-like cables which have become popular in the art.

In operation, push button switch 23 is pressed downwardly in the direction indicated by arrow 95 which in turn moves arm 70 downwardly against the spring force provided by return spring 77. In the preferred structure of push button switch 23, latch 101 is operative to latch push button 23 in the depressed position once it has been pushed. The downward travel of arm 70 in the direction of arrow 95 forces cam 100 against contact 73 which in turn brings contact 73 into electrical contact with contact 72 completing the battery power circuit for motor 67 and causing motor 67 to be energized and rotate air impeller 65. Concurrently, the downward motion of arm 70 is communicated to crank 75 by link 71 which in turn is coupled by pivot 54 to arm 53. As a result, arm 53 is pivoted about pivot 54 in the direction indicated by arrow 94 which separates valve stopper 52 from valve aperture 51 (the latter seen in FIG. 3). In accordance with the operation better seen in FIG. 3 and described in connection therewith, the separation of valve stopper 52 from valve aperture 51 produces the above-described introduction of bubble producing solution into foam chamber 55. The rotation of air impeller 65 draws air downwardly through air vent 27 in the direction indicated by arrows 90, 91 and 92 to produce the air flow described above upwardly through foam chamber 55 and center aperture 32 of nozzle 25 (seen in FIG. 3). This operation continues so long as switch 23 is depressed. Upon the release of switch 23 which in the preferred form of latch 101 is accomplished by again pushing push button switch 23, the return force of spring 77 forces push button 23 to and arm 70 upward. The upward motion of arm 70 withdraws cam 100 from contact 73 permitting contact 72 and 73 to separate and terminating the electrical energizing of motor 67. Concurrently, the upward motion of arm 70 pivots crank 75 and arm 53 to the position shown in FIG. 3 which in turn forces stopper 52 into valve aperture 51 terminating the transfer of bubble producing solution into the foam chamber. While not seen in FIGS. 3 or 4, in its preferred form, the bubble producing mechanism includes a return spring operable upon arm 53 to provide a further closing force and sealing action for valve stopper 52 within aperture 51. This return spring may be constructed in accordance with conventional fabrication techniques and may, for example, include a coiled spring having one arm stationary and the remaining arm coupled to arm 53.

What has been shown is an amusing and entertaining bubble dispensing doll which, in its preferred form, is configured to resemble a mythical mermaid-like creature. The bubble dispensing doll includes an integral bubble producing mechanism conveniently supported within the head and torso of the doll to produce a stream of bubbles emanating from the upper head and crown portion of the doll.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a doll body defining an interior cavity and having at least arm appendages, a head, and a torso;

a head piece ornament upon the upper portion of said head;

bubble dispensing means within said interior cavity for producing a stream of bubbles formed of a bubble solution, said bubble dispensing means including a battery power source, a bubble mixing chamber, an electric motor, and air impeller driven by said motor;

a bubble solution reservoir supported by said head and head piece coupled to said bubble dispensing means; and a bubble dispensing nozzle extending upwardly from said head and head piece ornament.

2. A doll as set forth in claim 1 wherein said head piece ornament includes a crown.

3. A doll as set forth in claim 2 wherein said crown forms a tiara.

4. A doll as set forth in claim 1 wherein said torso is fabricated to include a mermaid torso having an extending fish-like lower body, tail and tail fin.

5. A doll as set forth in claim 1 further including a plurality of synthetic hair strands secured to said head to form a human-like head of hair and wherein said head piece ornament is supported on said head above said hair.

6. A doll as set forth in claim 5 wherein said head piece ornament includes a crown.

7. A doll as set forth in claim 6 wherein said crown includes an upwardly extending decorative picket and an interior portion forming said reservoir and said nozzle.

8. A doll as set forth in claim 7 wherein said bubble dispensing means includes a support housing receiving and supporting said battery power source, said bubble mixing chamber, said electric motor and said air impeller in a single assembled unit.

9. A doll as set forth in claim 8 wherein said head defines an upwardly opening aperture and includes first attachment means formed by a resilient lip surrounding said aperture and wherein said support housing includes second attachment means including a groove for receiving said resilient lip to secure said bubble dispensing means within said interior cavity.

* * * * *